United States Patent [19]

Edamoto

[11] 4,222,553

[45] Sep. 16, 1980

[54] SLIDING NOZZLE APPARATUS FOR BLOWING POWDERY TREATING AGENT

[76] Inventor: Yoshito Edamoto, No. 3515 Totsukacho, Totsuka-ku, Yokohama-shi, Kanagawa-ken, Japan

[21] Appl. No.: 954,436

[22] Filed: Oct. 25, 1978

[30] Foreign Application Priority Data

Aug. 23, 1978 [JP] Japan ..... 53-114617[U]

[51] Int. Cl.[2] ..... C21C 5/48

[52] U.S. Cl. ..... 266/47; 75/60; 266/266

[58] Field of Search ..... 266/265, 47, 266; 75/52, 59, 60

[56] References Cited

U.S. PATENT DOCUMENTS

| | | | |
|---|---|---|---|
| 3,330,645 | 7/1967 | DeMoustier | 75/59 |
| 3,343,829 | 9/1967 | Coates | 75/59 |
| 3,971,548 | 7/1976 | Folgero | 266/265 |

FOREIGN PATENT DOCUMENTS

| | | | |
|---|---|---|---|
| 2801487 | 7/1978 | Fed. Rep. of Germany | 266/265 |

*Primary Examiner*—P. D. Rosenberg
*Attorney, Agent, or Firm*—Fay & Sharpe

[57] ABSTRACT

A sliding nozzle apparatus for blowing powdery treating agent in a molten metal vessel, in which a sliding plate consisting of refractory materials is provided with one or more of tuyeres for blowing powdery treating agent, and an upper nozzle consists of a gas permeable ceramic material.

3 Claims, 1 Drawing Figure

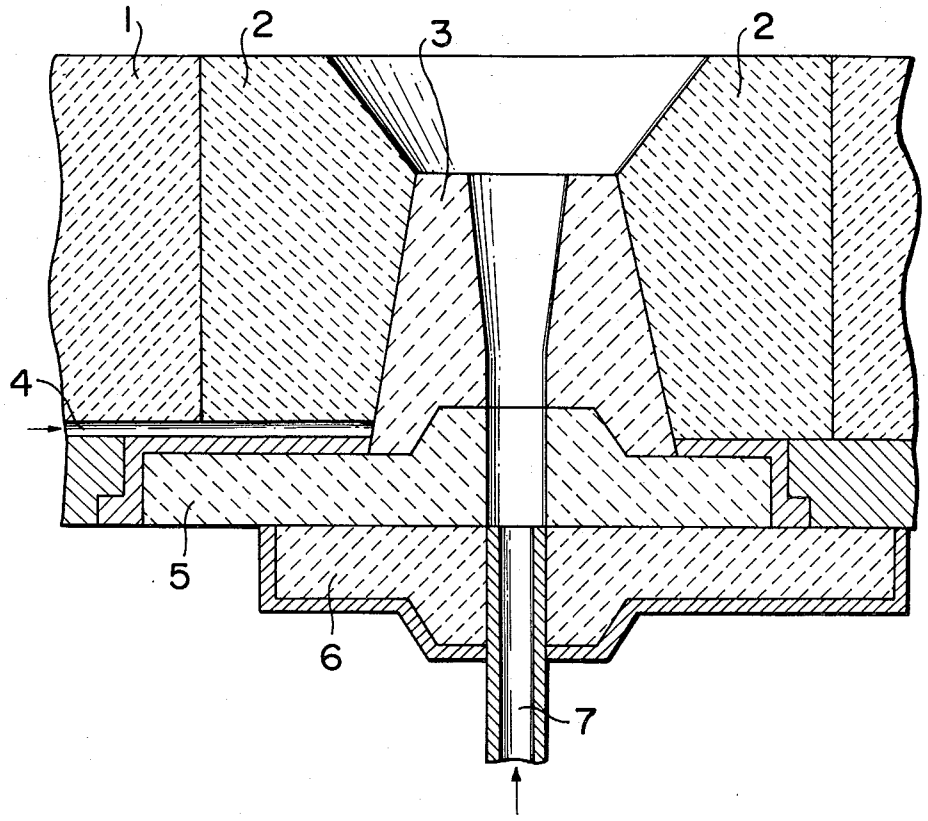
1
2
2
3
4
5
6
7

SLIDING NOZZLE APPARATUS FOR BLOWING POWDERY TREATING AGENT

The present invention relates to an improvement in or relating to a sliding nozzle apparatus for blowing powdery treating agent in molten metal vessel, in which apparatus a sliding nozzle is one for blowing gas into molten metal in the containers such as ladle, tundish and torpedo car or blowing a desulfurizing agent, an alloy and other treating agent and additive agent, with gas, and an upper nozzle is made of porous ceramic for blowing gas.

According to conventional bottom blown process of molten metal vessel, a blowing tuyere is fixed to the vessel so that at the time when gas is not blown, a small amount of gas must be being blown to avoid a counter flow of molten metal to the tuyere and a solidifying blockade of the tuyere. In such an instance there is a danger that the molten metal is sprayed because of gas bubbles, and further an expensive gas such as argon is wasted thereby bringing about a raised refining cost.

The present invention is constituted as clearly described in the claims. In the invention a tuyere is made by mounting a gas blowing pipe to an opening of the sliding plate of a sliding nozzle, said sliding nozzle is opened to blow gas, and said sliding plate is slid to a closing position at the same time as the blowing stoppage. Further, a gas film is formed at the inner surface of said upper nozzle through the porous upper nozzle when blowing gas, so as to prevent the nozzle mouth from closure at the time of blowing.

The invention will now be described further, by way of example only, with reference to the accompanying drawing which shows a sectional view of the sliding nozzle apparatus of the invention.

In the drawing, a gas permeable upper nozzle 3 is fitted closely to a well block 2 of the sliding nozzle provided in a molten metal vessel 1, said upper nozzle 3 is connected to a gas guiding pipe 4 for supplying gas into the nozzle to form a gas film at the inner surface of said nozzle, and it is prevented that a treating agent of molten metal and an additive agent adhere to the inner surface of the upper nozzle 3 to block the nozzle mouth, when they are blown. A bottom plate 5 is positioned beneath the upper nozzle 3, a sliding plate 6 mounted closely beneath said bottom plate 5 is slid, and part of the sliding plate 6 is provided with a gas blowing tuyere 7 to blow gas or blow, into the molten metal, powder of desulfurizing agent, deoxidizing agent, dephosphorizing agent and alloy thereby treating the molten metal. After finishing the blowing operation the sliding plate 6 is slid to close the blowing passage.

Thus, it is possible to avoid troubles of the tuyere, such as damage and blockade, and it is also capable of easily replacing the tuyere outside the vessel. It may suffice to provide a single tuyere, but when different kinds of gases are blown simultaneously more than two tuyeres may be bundled or they may be combined with inner and outer pipes. Further, the sliding nozzle can be provided not necessarily at the bottom portion of molten metal vessel but even at the side wall thereof to allow a side blowing.

The gas permeable upper nozzle 3 may be made of gas permeable ceramic such as porous alumina, corundum, mullite, silicon carbide, etc. For other parts of the apparatus there may be used the well block, the vessel lining brick, the castable refractory, the refractory materials for sliding nozzle and the like in themselves, which are presently in use. As the gases for blowing said treating agent and additive agent into the sliding nozzle made of said materials there are employed, besides inert gases such as argon and nitrogen, oxidizable gas such as oxygen, and reducing gases such as natural gas, propane, butene and carbon monoxide.

What is claimed is:

1. An apparatus for blowing a powdery treating agent into a vessel containing molten metal comprising: a gas permeable ceramic nozzle having a passageway therethrough which communicates with the interior of said vessel; a means for causing gas to impinge on said gas permeable nozzle whereby a gas film can be formed on the surface of said nozzle to prevent molten metal and molten treating agents from becoming bonded thereto; a bottom plate member for supporting said ceramic nozzle, said bottom plate member having a passageway therethrough communicating with the passageway through said ceramic nozzle; and a slideable plate member in contact with said bottom plate member, said slideable plate member being moveable between a first open position and a second closed position and having a tuyere therein for communicating with said opening in said bottom plate member when said slideable plate is in the open position whereby the flow of gas into said molten metal can be terminated by moving said slideable plate member to the closed position thereby removing the necessity of continuously blowing gas through said tuyere to prevent it from becoming blocked.

2. The apparatus of claim 1 wherein said gas permeable ceramic nozzle is a ceramic material selected from the group consisting of porous alumina, corundum, mullite, silicon carbide and mixtures thereof.

3. In the method of blowing a powdery treating agent into a vessel containing molten metal by means of an apparatus which includes a gas permeable ceramic nozzle having a passageway therethrough which communicates with the interior of said vessel; a means for causing gas to impinge on said gas permeable nozzle whereby a gas film can be formed on the surface of said nozzle to prevent molten metal and molten treating agents from becoming bonded thereto; a bottom plate member for supporting said ceramic nozzle, said bottom plate member having a passageway therethrough communicating with the passageway through said ceramic nozzle the improvement which comprises:

providing a slideable plate member in contact with said bottom plate member, said slideable plate member being moveable between a first open position and a second closed position and having a tuyere therein for communicating with said passageway in said ceramic nozzle when said slideable plate is in the open position whereby the flow of gas into said molten metal can be terminated by moving said slideable plate member to the closed position thereby removing the necessity of continuously flowing gas through said tuyere to prevent it from becoming blocked.

* * * * *